US006360646B1

(12) United States Patent
Tellander et al.

(10) Patent No.: US 6,360,646 B1
(45) Date of Patent: Mar. 26, 2002

(54) MAJORITY VOTING 3-STAGE SERVO VALVE SYSTEM

(75) Inventors: Robert M. Tellander; Kenneth W. Hummel, both of Coon Rapids; Kenneth P. Weichelt, White Bear Lake; Edward L. Rosenwinkel, Eden Prairie, all of MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 09/435,146

(22) Filed: Nov. 8, 1999

(51) Int. Cl.[7] ..... F41A 9/16
(52) U.S. Cl. ..... 89/46; 89/47
(58) Field of Search ..... 89/45, 46, 47

(56) References Cited

U.S. PATENT DOCUMENTS 2,403,886 A * 7/1946 Tweedale ..... 89/46
2,834,256 A * 5/1958 Wertman ..... 89/45
4,495,853 A * 1/1985 Gottwaldt ..... 89/46
4,860,633 A * 8/1989 Wiethoff et al. ..... 89/45

FOREIGN PATENT DOCUMENTS

EP 58814 * 1/1982 ..... 89/46

* cited by examiner

*Primary Examiner*—Stephen M. Johnson
(74) *Attorney, Agent, or Firm*—Patterson,Thuente, Skaar & Christensen, P.A.

(57) ABSTRACT

The invention discloses a structured set of electro-hydraulic pilot servo valves to operate an actuator arm to raise and lower an ammunition cradle. The servo valve structure and operational logic provides redundancy and reduces probability of failure. If one of the valves malfunctions, the remaining other two valves vote to carry more flow to compensate for the lost capacity thereby continuously maintaining system performance at pre-failure or near full capacity levels.

18 Claims, 4 Drawing Sheets

DRAWING "A"

MAJORITY VOTING 3-STAGE SERVO VALVE SYSTEM

FIELD OF THE INVENTION

The present invention relates to Servo valve systems which comprise one of the significant logistics components of a gun system for safe and efficient transfer of ammunition. Specifically, the present invention relates to servo valve systems which cooperate, in a majority voting sequence, to enhance gun system ammunition transfer and efficiency by improving reliability, maintainability and performance.

BACKGROUND OF THE INVENTION

The reliability of an ammunition transfer system is dependent on the efficiency and performance of the valves and controls involved in operating the transfer mechanism. Specifically, servo valves form a critical link in an ammunition transfer system and a malfunction of these components is detrimental to the smooth operation of the transfer mechanism. More specifically, if a pilot valve sticks at any position, the main stage spool of the valve could stroke unpredictably to either endpoint. Valve sticking may occur due to silting, contaminant build-up in the valve seat and similar environmental problems. A malfunctioning pilot valve may result in the actuator accelerating out of control thereby making the ammunition delivery unreliable and susceptible to failure.

Generally, a servo system is a closed loop control system that produces an error signal used to cancel any differences between an output and input command. The error signal drives an actuator that corrects the difference so the output will agree continuously with the input. Prior art three-stage electro-hydraulic servo valves typically use a single pilot valve for main stage spool control. Thus, if the single pilot valve malfunctions, the servo system becomes inoperative because the actuator will not be functional. Failures of this sort are detrimental to guns such as MK 45 gun systems whose readiness and rate of fire depend, to a large part, on the ammunition loading and transfer mechanism.

In a servo system the output variable is measured, fed back and compared to the desired input function at the summing point. The difference between the two values is an indication of the error which must be corrected. This setup generally requires a closed loop system. Closed loop servo systems are classified according to the variable being controlled. The most common forms of control are velocity, position, torque and combinations of these. The present invention relates to a servo valve system which is based on position control. Preferably, a resolver is used in the feedback loop to obtain position control. For example, sensors are used to determine that the shaft of the actuator has arrived at the desired angular position by counting pulses and comparing them with the input and stopping the shaft when the counts are equal. Further, a velocity feedback sensor loop may remain in the system to help in stabilizing it.

A stable servo system will always return to a stable operating state unless there is a component failure. However, the reliability of a weapon handling system could be significantly improved by structuring the servo valve systems in a manner to provide high level of availability and reliability at all times. Current systems do not use a compound set of servo systems which are able to compensate or step-in to perform the designated operation without interruption when a servo system fails. Specifically, as it relates to ammunition handling systems, the inventors are not aware of any system which utilizes a redundant set of servo valve systems which enable automatic switching of operations from a non-functional valve to a functional one based on a comparative error signal.

Accordingly, there is a need to enhance the reliability and availability of the servo valve systems operating in weapon handling equipment. Specifically, the electro-hydraulic valves in use in the MK 45 gun including ammunition handling systems in many other weapon systems, require a reliable servo valve system tailored to provide high reliability within permissible weight and space-volume parameters.

SUMMARY OF THE INVENTION

U.S Pat. No. 5,440,966 issued on Aug. 15, 1995, discloses a material hand-off device and process which uses a high performance hydraulic actuator to transfer ammunition. The power levels and speeds at which the actuator operates result in a system that is very sensitive to component failure. Thus, in an attempt to remedy the situation, various concepts were considered. For the most part, the present invention is an innovative solution to the problem encountered in controlling the actuator which operates the ammunition delivery system.

It is one of the objects of the present invention to provide a valve system for ammunition handling systems which is reliable and enables redundancy in case of failure of one or more of the valves. Specifically, the invention provides a microprocessor controlled servo valve system including a plurality of servo valves and transformers having input and output communications with a main stage spool, hereinafter referred to as the main spool, operating an actuator. More specifically, the system of the present invention includes a resolver, device for converting resolver signals to digital signals, a plurality of digital to analog converters, a plurality of error summing devices, a plurality of amplifiers and a plurality of voltage converters. The main stage spool further includes operable connections to the actuator on one side and to the servo valves and linear variable differential transformers (LVDTs) on another side. Furthermore, the actuator is connected to the resolver and the device for converting the resolver signals is connected to the microprocessor on an output side and the resolver on the input side. The microprocessor also includes connections with the digital to analog converters. The error summing devices provide connections to the digital to analog converters on a first side, the plurality of voltage converters on a second side and the plurality of amplifiers on a third side. The amplifiers are also structured to provide input to the servo valves.

It is yet another object of the invention to provide a servo valve system for precisely operating a material handling system to enable exchange and transfer of ammunition between a plurality of cooperative mechanisms. Specifically, the servo valve system includes a control system, an actuator and a main spool. The control system further includes a central microprocessor unit with operable electronic and data connections to a resolver, a digital converter of signals from the resolver, a plurality of digital to analog converters, a plurality of summer devices, a plurality of voltage converters, a plurality of amplifiers, a plurality of servo valve pilots and a plurality of LVDTs. The actuator is preferably connected to the main stage spool at the input side and the resolver at the output side. Further, the main stage spool is connected to the LVDTs and the servo valves.

It is a further object of the invention to provide a servo valve system to drive and control the motions of an ammunition handling system for engagement with a moving target attached to a gun tube rotatable through an arc above and below a horizontal azimuth. The servo system and the ammunition handling system, in combination, preferably include a control system and a main stage spool operable via a set of three electro-hydraulic pilot servo valves. Each of the pilot servo valves, hereinafter referred to as servo valves, are connected to LVDTs and form a configuration in which the set of preferably three servo valves operate the actuator. Further, the ammunition handling system includes a cradle that is matingly engageable with a slide mechanism to transfer the ammunition thereto. Upon transfer to the slide mechanism, the ammunition is ultimately fed into the gun tube. The ammunition handling system therefore includes two dynamic systems. The first system being an actuator driven cradle and the second being a slide that is attached to the gun tube. Both the cradle and the slide are adjustable to raisable and tiltable positions relative to a horizontal azimuth. The actuator includes an extendable dynamic arm that is implemented to raise and lower the cradle for engagement with the slide.

It is yet another object of the present invention to provide a device-implemented method of maintaining the reliability of an ammunition supply system using a plurality of pilot servo valves to supply undiminished power to an actuator for driving an ammunition handling device in which ammunition is transferred to and from a gun chamber. In the preferred embodiment, the method includes the steps of providing at least three servo valves to operate a main stage spool. Further, the method includes operating an actuator while monitoring positions of the main stage spool. The method also includes correcting errors by summing signals from a plurality of digital to analog converters and a plurality of transformer position to voltage converters.

Generally, the majority voting three-stage servo valve system of the present invention incorporates three servo valves for the control of the main stage spool. Each of the servo valves is controlled by a separate electrical main stage spool position feedback control system. The main stage spool position is monitored by a triple redundant set of LVDTs. The result is three servo valves operating independently. This structure provides a feedback control system which is highly reliable and provides an efficient redundancy at a substantially reduced probability of failure.

The above features and advantages of the present invention will become apparent upon consideration of the following detailed description of several specific embodiments thereof, especially when taken in conjunction with the accompanying drawings.

DESCRIPTION OF THE PREFERRED EMBODIMENT

Figure 1:
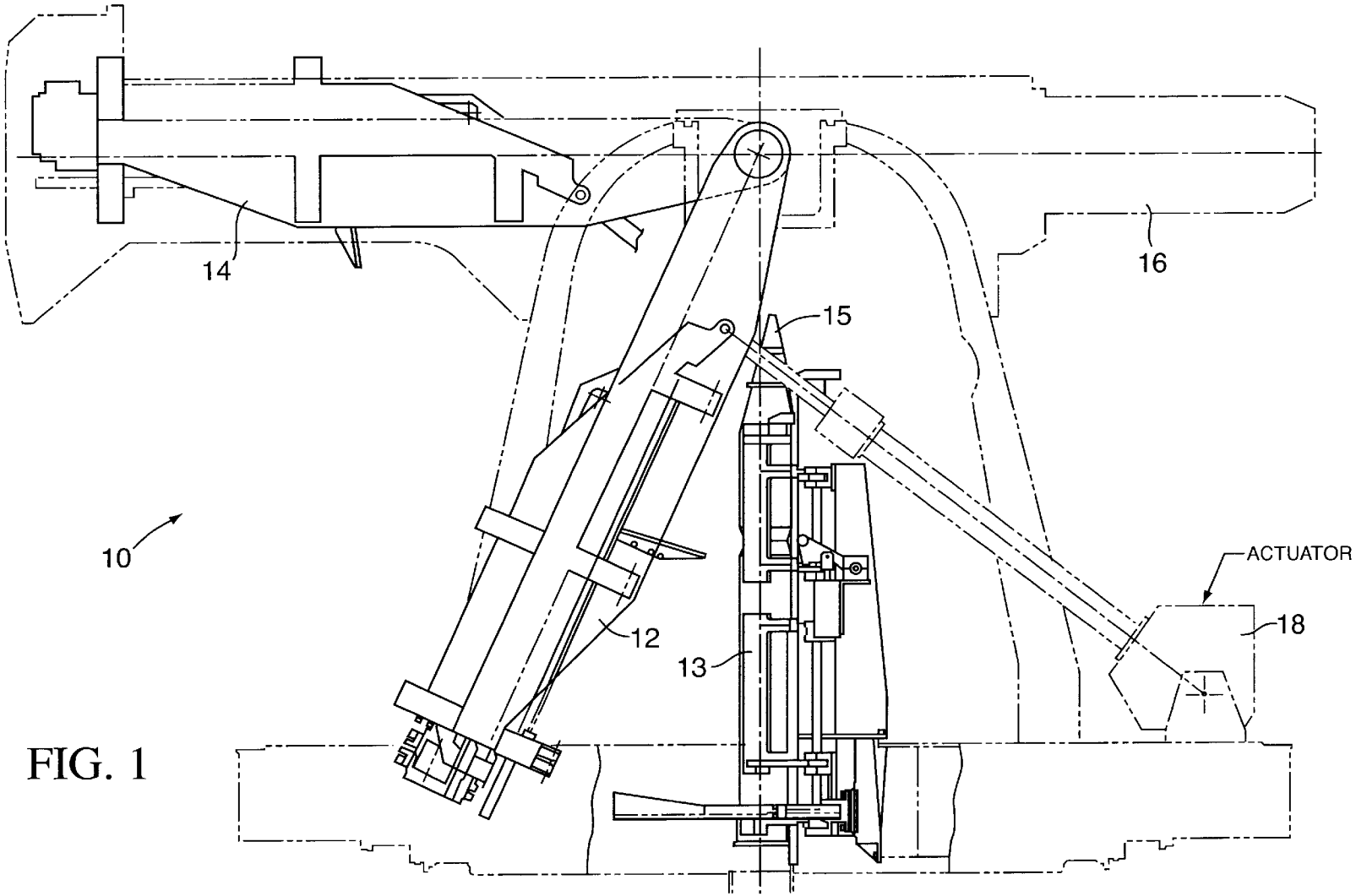
FIG. 1 is an elevation drawing of a MK 45 type gun system showing a typical ammunition transfer space-volume locus wherein an ammunition is transferred from a storage to a gun breech.

Referring now to FIG. 1, an ammunition handling system 10 is shown in which cradle 12 is raised to engage slide 14. Ammunition supply 13 delivers ammunition 15 to be picked up by cradle 12. Ammunition supply 13 and cradle 12 are designed to cooperatively operate to transfer ammunition from storage into slide 14 from where ammunition 15 is fed into gun tube 16. Actuator 18 raises and lowers cradle 12 to shuttle between ammunition supply 13 and slide 14.

The present invention is particularly focussed on actuator 18 where, preferably a plurality of servo valves operate two pistons. The precise and reliable operation of actuator 18 is critical for delivering ammunition 15 on time and further to prevent a "Run-Away" cradle which may collide with end-points at excessive speed thereby damaging either ammunition 15 or slide 14. Another concern with a malfunctioning actuator is the fact that the rate of fire and gun system performance are directly dependent on the reliability of actuator 18. The speed of cradle 12 is dependent upon the hydraulic flow and performance efficiency of the servo valve system. Thus, the basis of the present invention is enhancement of the servo valve system to ensure a reliable operation of cradle 12.

Figure 2:
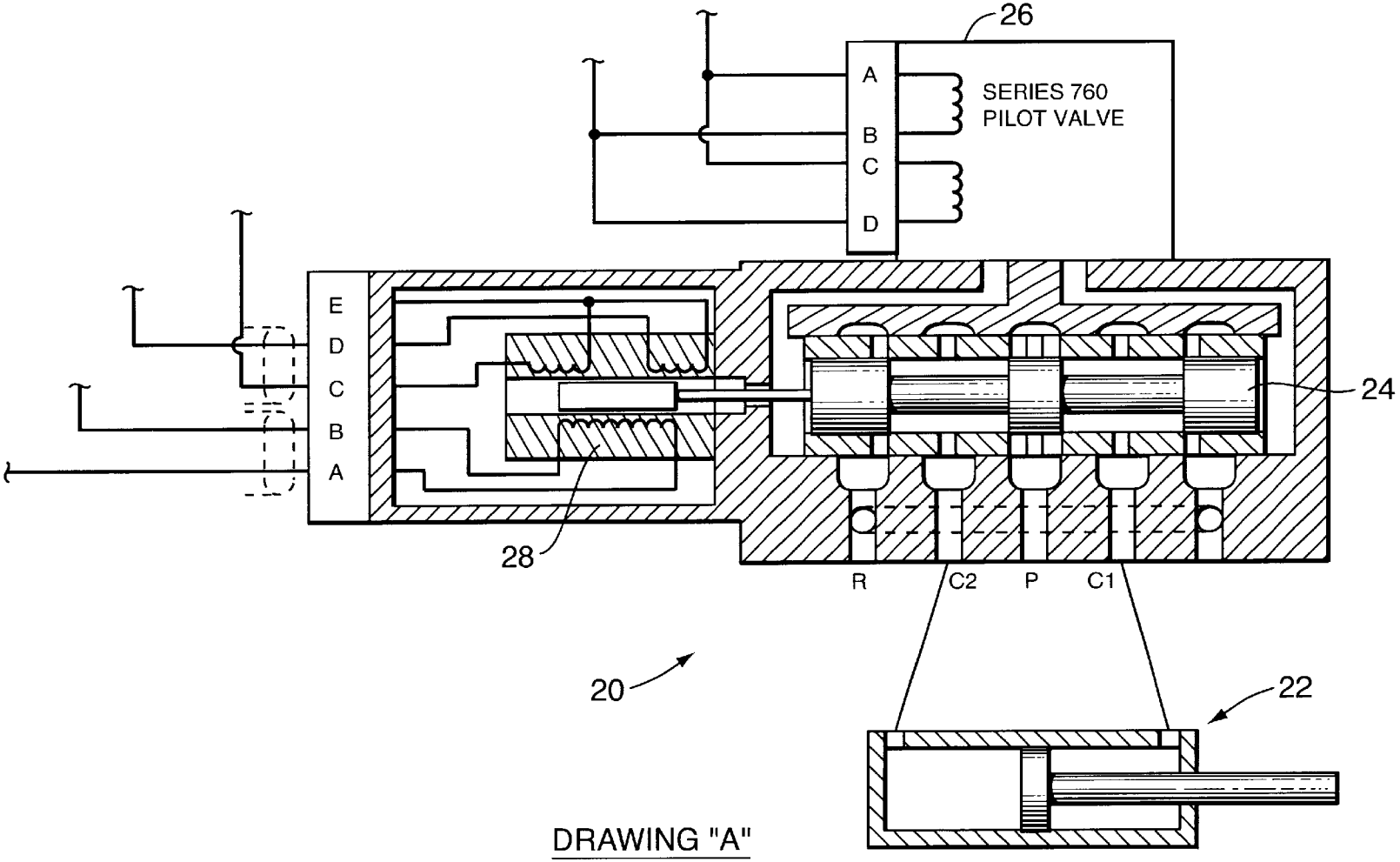
FIG. 2 shows a typical arrangement of a servo valve implemented to drive an actuator.

Referring now to FIG. 2, a servo valve structure 20 is shown including the major components. Actuator 22 is controlled by main stage spool 24. Further, pilot servo valve 26 provides control for main stage spool 24. The position of main stage spool 24 is monitored by a redundant set of LVDTs 28. Generally the system operates to coordinate the position and speed of actuator 22 to thereby indirectly control systems that are operated/engaged by actuator 22.

Figure 3:
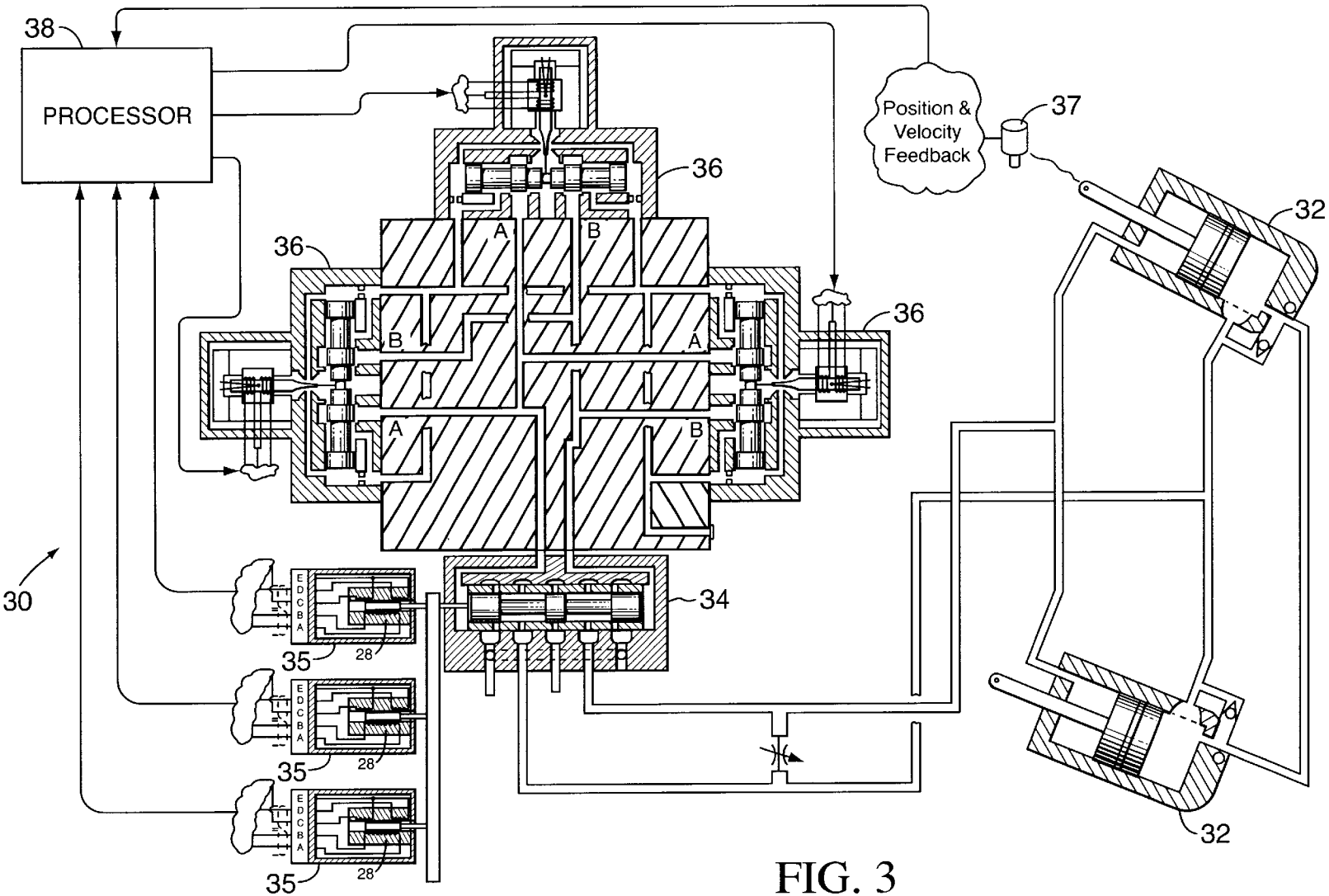
FIG. 3 shows the major components of the present invention and their cooperative structure comprising the invention.

Referring now to FIG. 3, three pilot servo valves are structured as shown. The structure represents a general scheme in which actuators 32 are in communications with main stage spool 34. The connection includes a circuit comprising hydraulic supply and return lines. Main stage spool 34 includes connections to servo valves 36 including a hydraulic supply and return circuit therein. Further, main stage spool 34 is connected to LVDTs 35. Resolver 37 is implemented to monitor the position and velocity of actuator 32. Generally resolver 37 is a rotary electromechanical transformer or equivalent that can sense position and/or velocity in servo control systems. Related to a synchro unit, resolver 37 preferably contains a rotor and a stator. There are three widely used techniques for converting resolver outputs into digital format: (i) tracking, (ii) successive approximation, and (iii) time phase shift. Although, the present invention is adaptable to any of the above conversion techniques, in the preferred embodiment, tracking is implemented. Processor 38 is used to process input and output. Specifically, input data is received from LVDTs 35 and resolver 37. The input data is processed and communicated to servo valves 36. Servo valves 36 comprise a closed-loop control system that produces an error signal which is used to cancel any differences between the output and the input command. The error signal drives actuator 32 and thus corrects the difference so that the output will agree continuously with the input.

As indicated hereinabove, the objective of servo systems is preferably to maintain zero error with a response that is as rapid as possible. Closed-loop feedback control provides accurate positioning because it continually tries to correct any error that exists. However, if there is a delay in error correction due to poor system response, the error will increase until the system becomes unstable. As will be seen hereinbelow, the present invention implements unique structures and logic to provide a highly reliable servo system within a closed loop environment.

Figure 4:
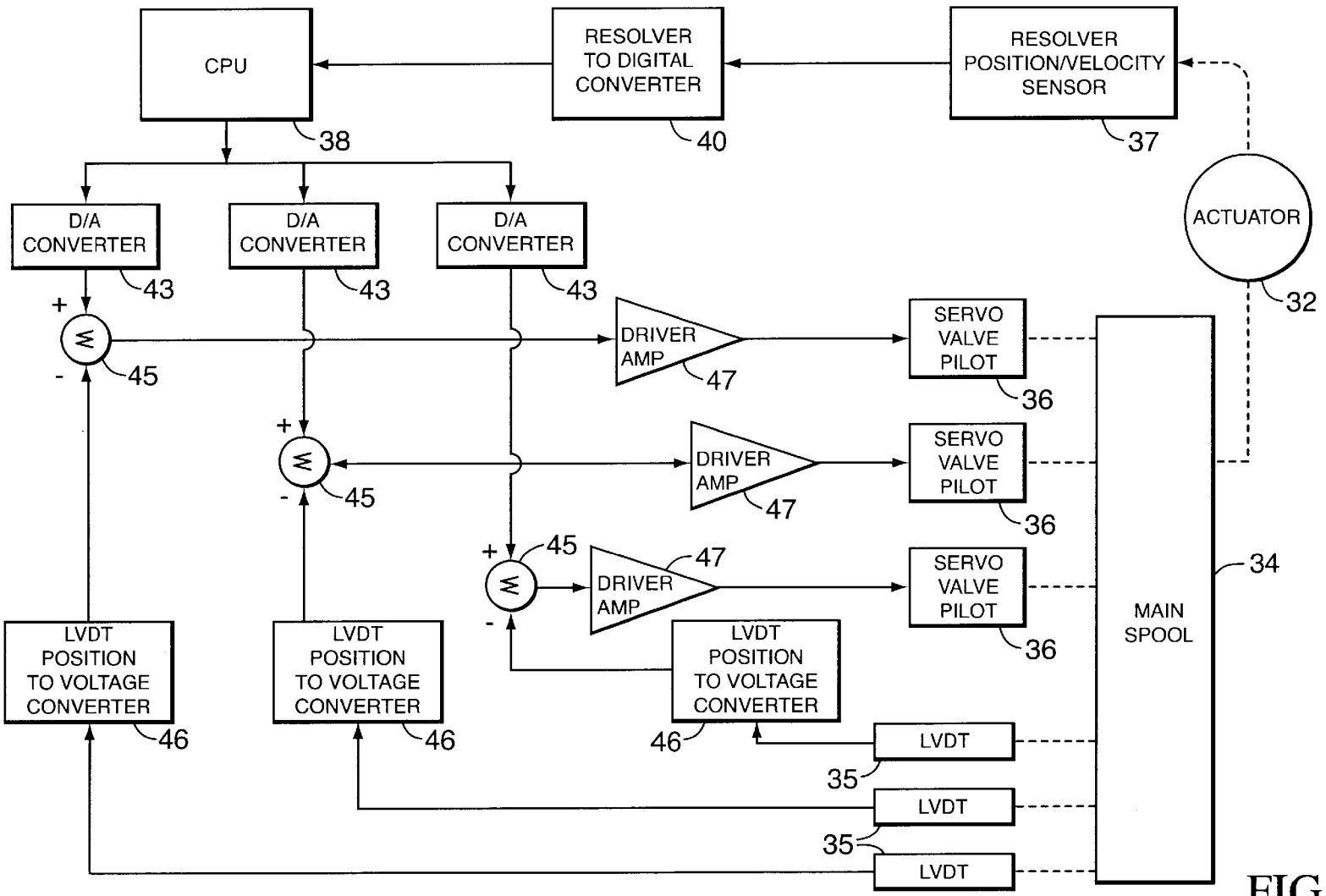
FIG. 4 is a schematic showing a high level logic architecture including system operation and control of the servo valve system of the invention.

Referring to FIG. 4, main stage spool 34 output drives actuator 32. On the input side, main stage spool 34 is connected to a plurality of servo valves 36 and LVDTs 35. Resolver 37 is set to sense the position and velocity of actuator 32. The signals sensed by resolver 37 are analog in nature and are converted to digital via converter 40. The digital signal is routed as an input into CPU 38 for processing. After processing, the signal is converted back to analog by converters 43. The analog signal is then directed into summer units 45 to correct any errors that may exist. Further, summer units 45 are connected to the output of converter units 46. Converter units 46 accept analog signals from LVDTs 35 and convert them to voltage readings. Summers 45 correct any discrepancies and errors that exist between the input signals from converters 43 and converters 46. The resultant, corrected signal is fed into driver amplifiers 47. Amplifiers 47 direct the amplified signals into servo valves 36. The signals from servo valves 36 are fed into the input side of main stage spool 34. These signals are used to correct, adjust and modify the operations of actuator 32, thereby forming a closed loop servo system.

Accordingly the structure and logic of the present invention enables servo valves 36 to work in any pair or three combination as shown. The majority voting concept is applied to a three-stage servo valve which improves the reliability of the valve package. For example, as shown in FIG. 2 , a conventional three-stage servo valve includes one pilot valve controlling the power stage. Thus, a majority voting three-stage valve system could be designed to provide three pilot valves controlling the power stage. If the probability of failure of a conventional three-stage valve is 0.01 the probability of a voting three-stage servo valve, as implemented in the present invention is 0.0003.

The present invention therefore provides a three-stage electro-hydraulic servo valve system. In accordance with FIG. 3 the overall configuration of the system includes a closed loop system comprising servo valves 36 each having independent LVDTs 35 and sharing a common main stage spool 34. Servo valves 36 are integrated as shown to control main stage spool 34. Thus, if any one of the valves fails, the other two valves will compensate and keep main stage spool 34 under control. Since any two servo valves among the three are a majority, the valve structure in accordance with the present invention provides at least two operational valves after the failure of any one of the three valves.

Accordingly, with reference to FIG. 1, the present invention is used to operate a high performance hydraulic actuator 18. The power and speed at which actuator 18 operates require high level accuracy and sensitivity to component failure. The majority voting three-stage electro-hydraulic servo valve system of the present invention meets these stringent requirements. Specifically, actuator 18 rotates a 1000 pound weight through 25 degrees to 105 degrees. One of the end points is slide 14 which is dynamic. The time for motion varies from 0.35 seconds to 0.60 seconds depending upon the position of gun tube 16 and the angle through which cradle 12 must be raised to engage slide 14. There are two motions involved. The first is encountered when cradle 12 is raised. During this operation the servo valve system may not use sleeve buffing to decelerate cradle 12 because the end point is dynamic, i.e., slide 14 may be moving. Thus, cradle 12 is under servo control during the raising cycle of cradle 12. The second motion is encountered during a cycle in which cradle 12 is being lowered. In this case, the endpoint is non-moving and the actuator uses buffing on the sleeve to decelerate cradle 12. In the prior art the servo valve was held wide open during the entire cradle lowering cycle. Specifically, the prior art solution to servo valve failure was the use of an abort circuit. The abort circuit predicted a response time of 40 msec. This was adequate except in situations in which when the pilot stage of the servo valve sticks causing the main stage spool to go hard in one direction. Solutions to speed up the abort cycle were considered but were found ineffective. The present invention overcomes the limitation of the prior art by implementing three servo valves which, even if one of the three fails, the other two compensate for the flow of hydraulic pressure to maintain the same power level to either raise or lower cradle 12. Thus, the redundancy including the associated controls of the present invention provide a high level of reliability and maintainability to the ammunition supply system and thereby enhance gun performance.

While the preferred embodiments of the invention have been shown and described, it will be obvious to those skilled in the art that changes, variations and modifications may be made therein without departing from the invention in its broader aspects and, therefore, the aim in the appended claims is to cover such changes and modifications as fall within the scope and spirit of the invention.

What is claimed is:

1. A servo valve system for precisely operating a material handling system to enable exchange and transfer of ammunition between a plurality of cooperative mechanisms, the servo valve system comprising:

a control system;

an actuator; and a main spool;

said control system including a central microprocessor unit having operable electronic and data connections with a resolver, a digital converter of signals from the resolver, a plurality of digital to analog converters, a plurality of summer devices, a plurality of voltage converters, a plurality of amplifiers, a plurality of servo valve pilots and a plurality of LVDTs wherein said actuator is connected to said main spool on one side and said resolver on another side and further said main spool being connected to said plurality of LVDTs and said plurality of servo valve pilots.

2. The servo valve system of claim 1 wherein said plurality of summer devices accept data from said plurality of digital to analog converters on one of a first of three data ports.

3. The servo valve system of claim 2 wherein said plurality of summer devices accept data from said plurality of voltage converters on one of a second of three data ports.

4. The servo valve system of claim 3 wherein said plurality of summer devices process the data accepted from said plurality of digital to analog converters and said plurality of voltage converters to provide an adjusted substantially error-free output at a third of said three data ports.

5. The servo valve system of claim 4 wherein said third data port is connected to said plurality of amplifiers.

6. The servo valve system of claim 5 wherein said plurality of amplifiers are connected to a plurality of said servo valve pilots.

7. A servo valve system to drive and control the motions of an ammunition handling mechanism to engage a moving target attached to a gun tube rotatable through an arc above and below a horizontal azimuth the servo system and the ammunition handling mechanism, in combination, comprising:

a control system;

a main stage spool operable via a set of electro-hydraulic pilot servo valves;

each of said pilot servo valves being connected to a linear variable differential transformer;

an actuator being operated by said set of pilot servo valves; and said ammunition handling mechanism being matingly engageable with a slide to transfer said ammunition thereto;

said ammunition handling mechanism being one of a dynamic system of the ammunition handling mechanism which is attached to the gun tube with a raisable and tiltable positions relative to said horizontal azimuth and said actuator having an extendable arm to raise and lower said cradle for engagement with said slide.

8. The pilot servo valves of claim 7 wherein said set of pilot servo valves comprises three pilot servo valves, and said transformers and said main stage spool cooperate to enable any two of said three pilot servo valves to compensate for a malfunctioning pilot servo valve and accommodate increased hydraulic flow to provide undiminished power to said actuator.

9. The pilot servo valves of claim 8 wherein said any two of said pilot servo valves share additional hydraulic flow to compensate for diminished hydraulic pressure due to said malfunctioning pilot servo valve.

10. A method of maintaining the reliability of an ammunition supply system using a plurality of pilot servo valves to provide undiminished power to an actuator for driving an ammunition handling device in which ammunition is transferred to and from a gun chamber, the method comprising the steps of:

providing three said pilot servo valves to operate a main stage spool and said actuator;

monitoring positions of said main stage spool; and correcting actuator errors by summing signals regarding position and velocity of said actuator from a plurality of digital to analog converters and voltage readings regarding position of said main stage spool from a plurality of transformer position to voltage converters.

11. The method according to claim 10 wherein said step of monitoring includes adjusting hydraulic pressure across said three pilot servo valves to control said main stage spool.

12. The method according to claim 11 wherein said step of adjusting hydraulic pressure includes one of equally increasing hydraulic pressure between two functional servo valve pilots to thereby compensate for the pressure loss of a malfunctioning servo valve pilot.

13. The method according to claim 12 wherein said step of adjusting hydraulic pressure includes operating an LVDT to monitor a position of said main stage spool.

14. The method according to claim 10 wherein said step of correcting errors includes implementing a resolver to sense positions and velocity of the actuator.

15. The method according to claim 10 wherein said step of correcting errors includes implementing a central processing unit to accept signals from a resolver, to process said signals, and to send said processed signals to a plurality of summer devices.

16. The method according to claim 15 wherein said step of correcting errors further includes providing signals from a plurality of LVDTs regarding position of said main stage spool, converting said signals to said voltage readings, and sending said voltage readings to a plurality of summer devices to thereby output corrected signals.

17. The method according to claim 16 wherein said corrected signals are introduced into a plurality of amplifiers as input and are subsequently introduced as signals into said plurality of pilot servo valves.

18. A method for maintaining the reliability of an ammunition supply system using a plurality of pilot servo valves in a closed loop servo system to provide undiminished power to an actuator for driving an ammunition handling device in which ammunition is transferred to and from a gun chamber, the method comprising the steps of:

providing at least three pilot servo valves operably connected to a main stage spool so that the pilot servo valves function in parallel; and controlling main stage spool position by adjusting hydraulic pressure to the main stage spool from across the three pilot servo valves, whereby any at least two pilot servo valves compensate for another pilot servo valve that is malfunctioning.

* * * * *